US008348260B2

(12) United States Patent
Bakker et al.

(10) Patent No.: US 8,348,260 B2
(45) Date of Patent: Jan. 8, 2013

(54) DOCUMENT PROCESSING APPARATUS, ASSEMBLY AND SUB-ASSEMBLY AND METHOD FOR OPERATING THE SAME

(75) Inventors: Johan P. Bakker, Brighton, MI (US); George T. Spray, Livonia, MI (US); David B. Tratar, Dearborn, MI (US); James M. Spall, Commerce, MI (US); Michael J. Moore, Beverly Hills, MI (US)

(73) Assignee: Burroughs, Inc., Plymouth, MI (US)

( * ) Notice: Subject to any disclaimer, the term of this patent is extended or adjusted under 35 U.S.C. 154(b) by 0 days.

(21) Appl. No.: 13/036,703

(22) Filed: Feb. 28, 2011

(65) Prior Publication Data

US 2012/0217695 A1 Aug. 30, 2012

(51) Int. Cl.
*B65H 1/26* (2006.01)
*B65H 1/06* (2006.01)

(52) U.S. Cl. ..... 271/157; 271/147

(58) Field of Classification Search ..... 271/126, 271/149, 157, 160
See application file for complete search history.

(56) References Cited

U.S. PATENT DOCUMENTS

| | | | | |
|---|---|---|---|---|
| 3,949,979 | A | 4/1976 | Taylor et al. | |
| 4,522,385 | A | 6/1985 | Stefansson | |
| 4,523,832 | A | 6/1985 | Strutt et al. | |
| 5,199,694 | A * | 4/1993 | Iseda | 271/9.05 |
| 5,228,676 | A * | 7/1993 | Arai et al. | 271/117 |
| 5,249,787 | A | 10/1993 | Ifkovits | |
| 5,624,109 | A | 4/1997 | Tanaka | |
| 5,678,814 | A | 10/1997 | Yokoyama et al. | |
| 5,755,435 | A | 5/1998 | Fujiwara | |
| 5,784,680 | A | 7/1998 | Taruki | |
| 6,135,442 | A | 10/2000 | Hirata et al. | |
| 6,168,147 | B1 | 1/2001 | Nose et al. | |
| 6,260,840 | B1 * | 7/2001 | Suga et al. | 271/10.12 |
| 6,354,584 | B1 * | 3/2002 | Suga et al. | 271/10.12 |
| 6,390,462 | B1 | 5/2002 | Ouchi et al. | |
| 6,533,263 | B2 | 3/2003 | Tamura | |
| 6,672,581 | B2 | 1/2004 | Lee et al. | |
| 7,422,205 | B2 | 9/2008 | Akiyama et al. | |
| 2002/0096817 | A1 | 7/2002 | Miki | |
| 2003/0116906 | A1 | 6/2003 | Amamoto | |
| 2007/0257424 | A1 | 11/2007 | Okazaki | |
| 2008/0018044 | A1 | 1/2008 | Kim | |
| 2009/0014943 | A1 * | 1/2009 | Sasaki | 271/10.09 |
| 2010/0013145 | A1 | 1/2010 | Spall et al. | |
| 2010/0219578 | A1 * | 9/2010 | Sasaki | 271/126 |

OTHER PUBLICATIONS

Non-Final Office Action dated Jun. 8, 2010 relating to U.S. Appl. No. 12/176,804.
Final Office Action dated Dec. 20, 2010 relating to U.S. Appl. No. 12/176,804.

* cited by examiner

*Primary Examiner* — Patrick Cicchino
(74) *Attorney, Agent, or Firm* — Honigman Miller Schwartz and Cohn LLP

(57) ABSTRACT

A sub-assembly of a document processor that routes at least one document from an input hopper, along a document path and to an output bin is disclosed. The document processor includes a flag movably-arranged within the input hopper to/from a closed orientation and an open orientation; a rod fixed to and extending from the flag, wherein the rod includes an outer surface; a cam member including a camming surface, wherein the camming surface is communicatively-coupled to the outer surface of the rod; a driven shaft connected to the cam member, wherein the cam member further includes a one-way clutch, wherein the driven shaft extends through the one-way clutch; and a feed motor connected to the driven shaft. A method for operating the sub-assembly is also disclosed.

11 Claims, 11 Drawing Sheets

DOCUMENT PROCESSING APPARATUS, ASSEMBLY AND SUB-ASSEMBLY AND METHOD FOR OPERATING THE SAME

TECHNICAL FIELD

The disclosure relates to a document processing apparatus, assembly, sub-assembly and a method for operating the same.

BACKGROUND

Document processing machines are known in the art. Although known document processing machines perform adequately for their intended use, improvements are nevertheless continuously being sought in order to advance the art.

DESCRIPTION OF THE DRAWINGS

The disclosure will now be described, by way of example, with reference to the accompanying drawings, in which.

DETAILED DESCRIPTION

The figures illustrate an exemplary implementation of a document processing apparatus, assembly, sub-assembly and a method for operating the same. Based on the foregoing, it is to be generally understood that the nomenclature used herein is simply for convenience and the terms used to describe the invention should be given the broadest meaning by one of ordinary skill in the art.

Figure 1:
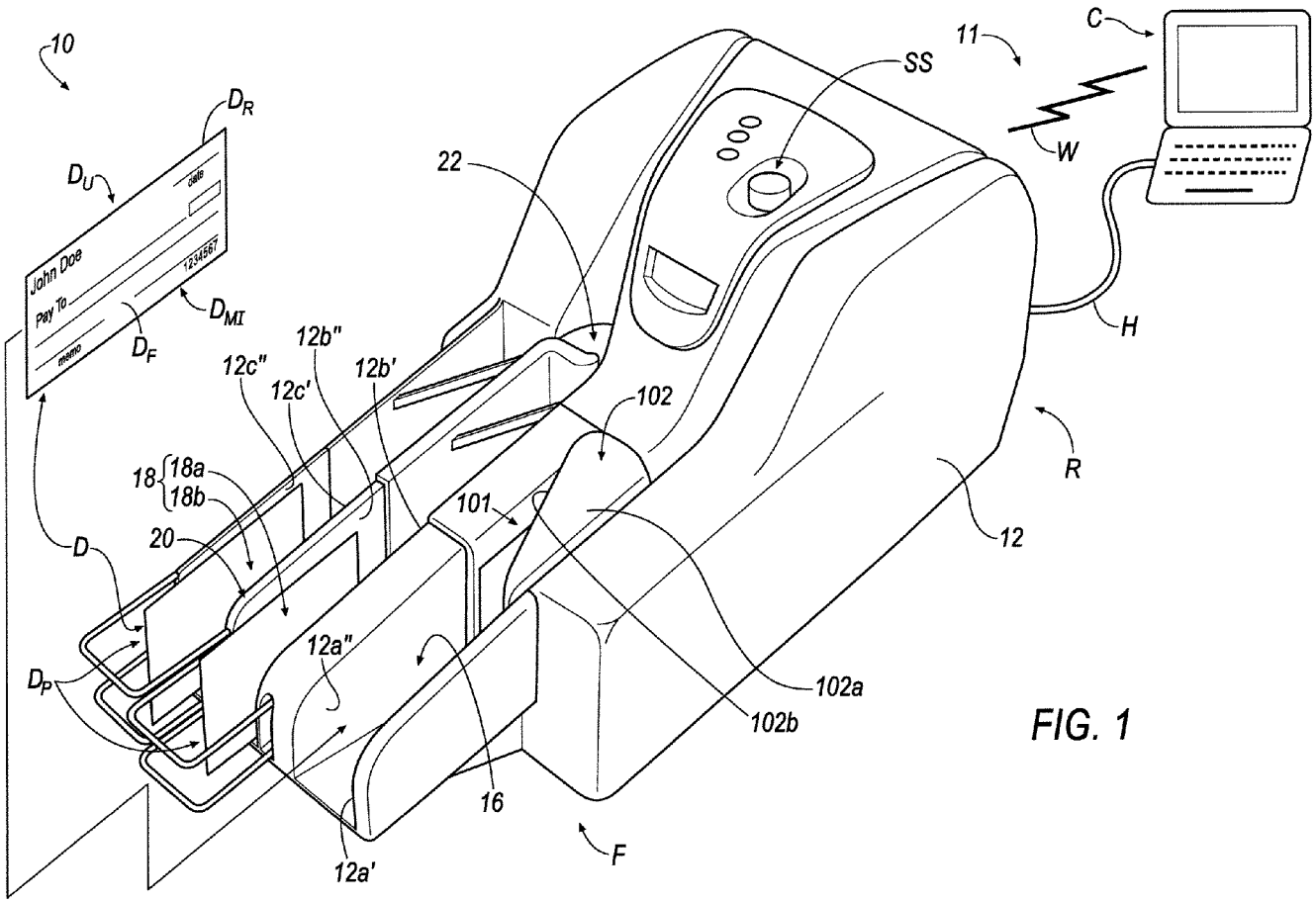
FIG. 1 is a top perspective view of an exemplary document processing apparatus.

FIG. 1 illustrates an exemplary implementation of an apparatus 10 that processes at least one document, D. Accordingly, in an implementation, the apparatus 10 may be referred to as a "document processor." In an implementation, the at least one document, D, may include, but is not limited to, at least one financial/payment document (e.g., at least one check) or the like.

The processing of the at least one document, D, that is conducted by the document processor 10 may include the recording of and/or an analysis of one or more characteristics associated with one or more of a front surface, $D_F$, of the at least one document, D, and a rear surface, $D_R$, of the at least one document, D. In an implementation, the document processor 10 includes electronics 15 (see, e.g., FIGS. 2A-2C) that may include, but is not limited to, one or more document processing application functions such as, for example: (1) imaging of one or more of the front and rear surfaces, $D_F$, $D_R$, of the at least one document, D, for recording an image of symbols and/or written indicia and/or printed indicia disposed upon one or more of the front and rear surfaces, $D_F$, $D_R$, of the at least one document, D, (2) converting the imaged symbols and/or written indicia and/or printed indicia upon one or more of the front and rear surfaces, $D_F$, $D_R$, of the document, D, into electronic form by way of, for example, optical character recognition (OCR) software, (3) magnetic ink character recognition (MICR) reading for magnetically identifying characters that are printed upon one or more of the front and rear surfaces, $D_F$, $D_R$, of the document, D, with magnetic ink, $D_{MI}$, (4) endorsing, (5) bar code reading, (6) biometric reading and the like.

In an implementation, the document processor 10 may include a communication interface 11 that permits the document processor 10 to: receive commands from an operator and/or send processed document information to: a computer, C, database or the like. In an embodiment, the communication interface 11 may peunit wireless communication, W, or hardwired communication, H, to, for example, the computer, C, database or the like, by way of, for example, WiFi connection, an Ethernet connection, a Universal Serial Bus (USB) connection or the like.

Figure 2A:
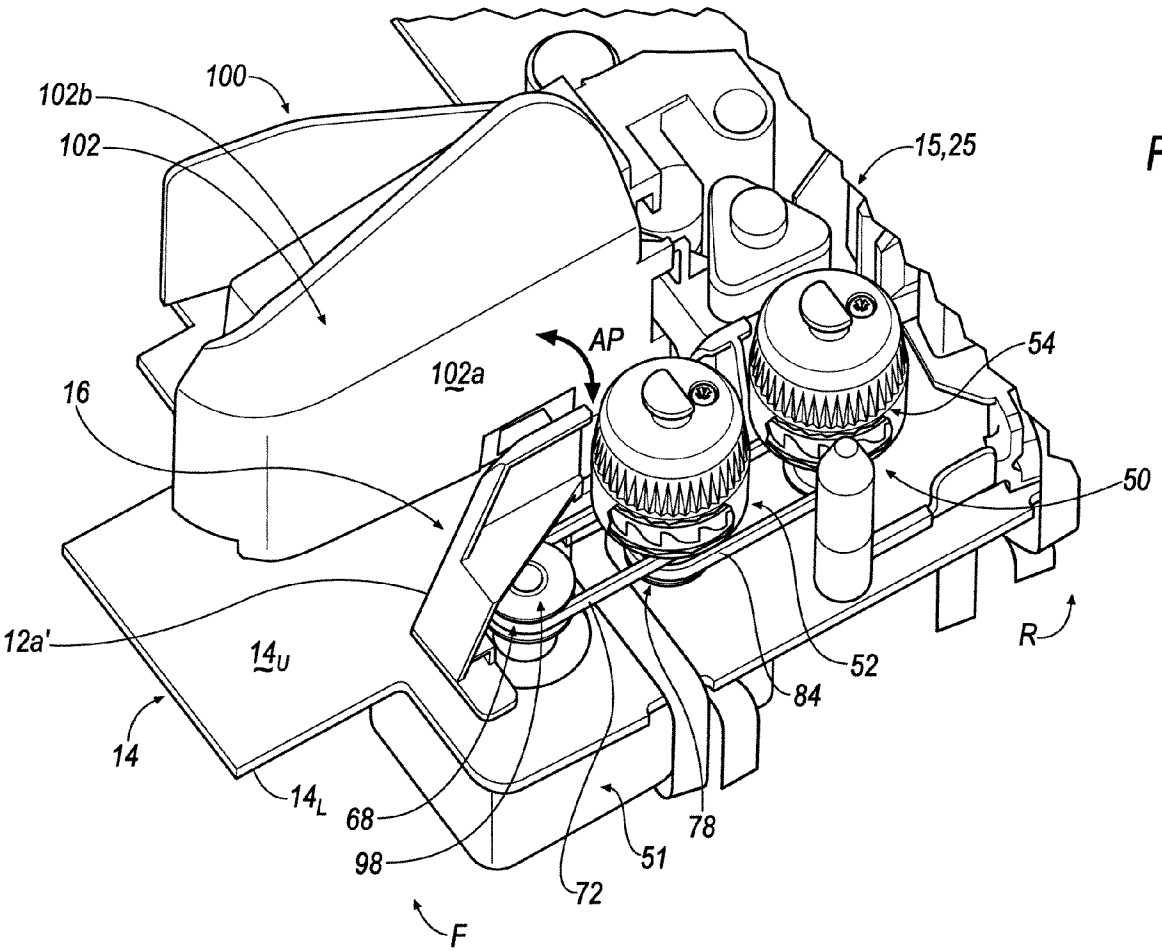
FIG. 2A is a partial, top perspective view of an exemplary document processing apparatus.
Figure 2B:
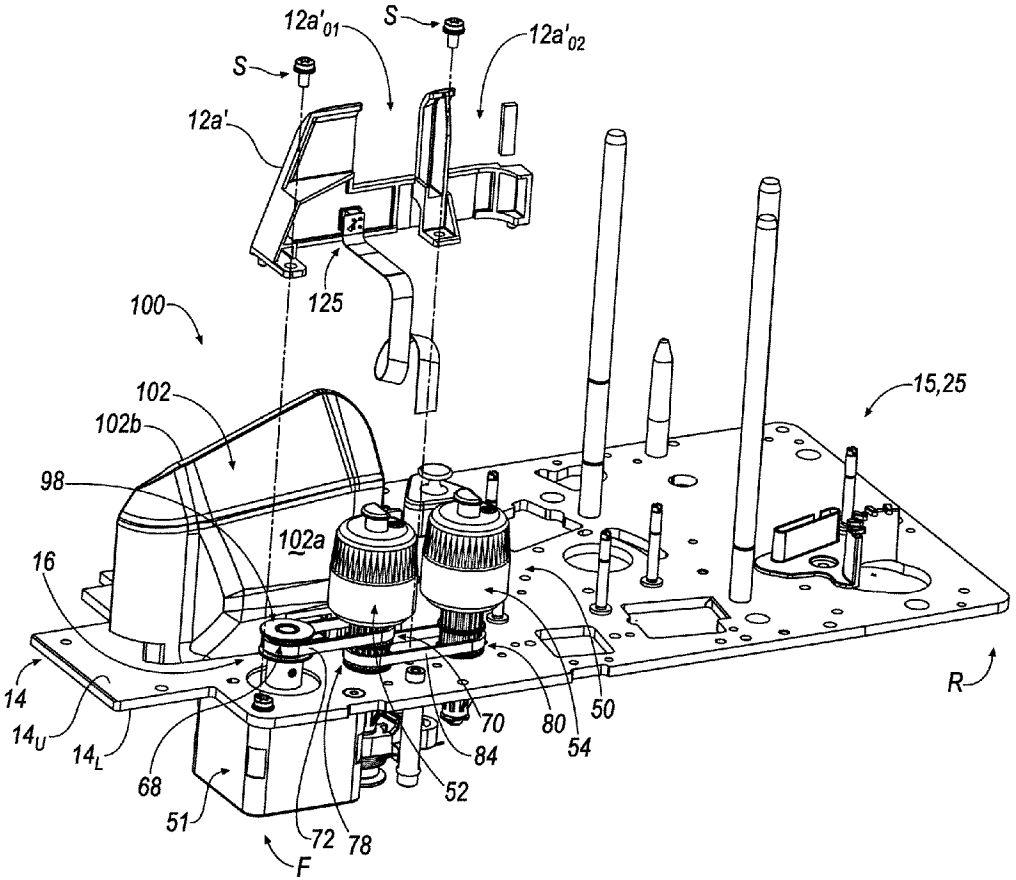
FIG. 2B is a top partial assembled/partial exploded perspective view of an exemplary document processing apparatus.
Figure 2C:
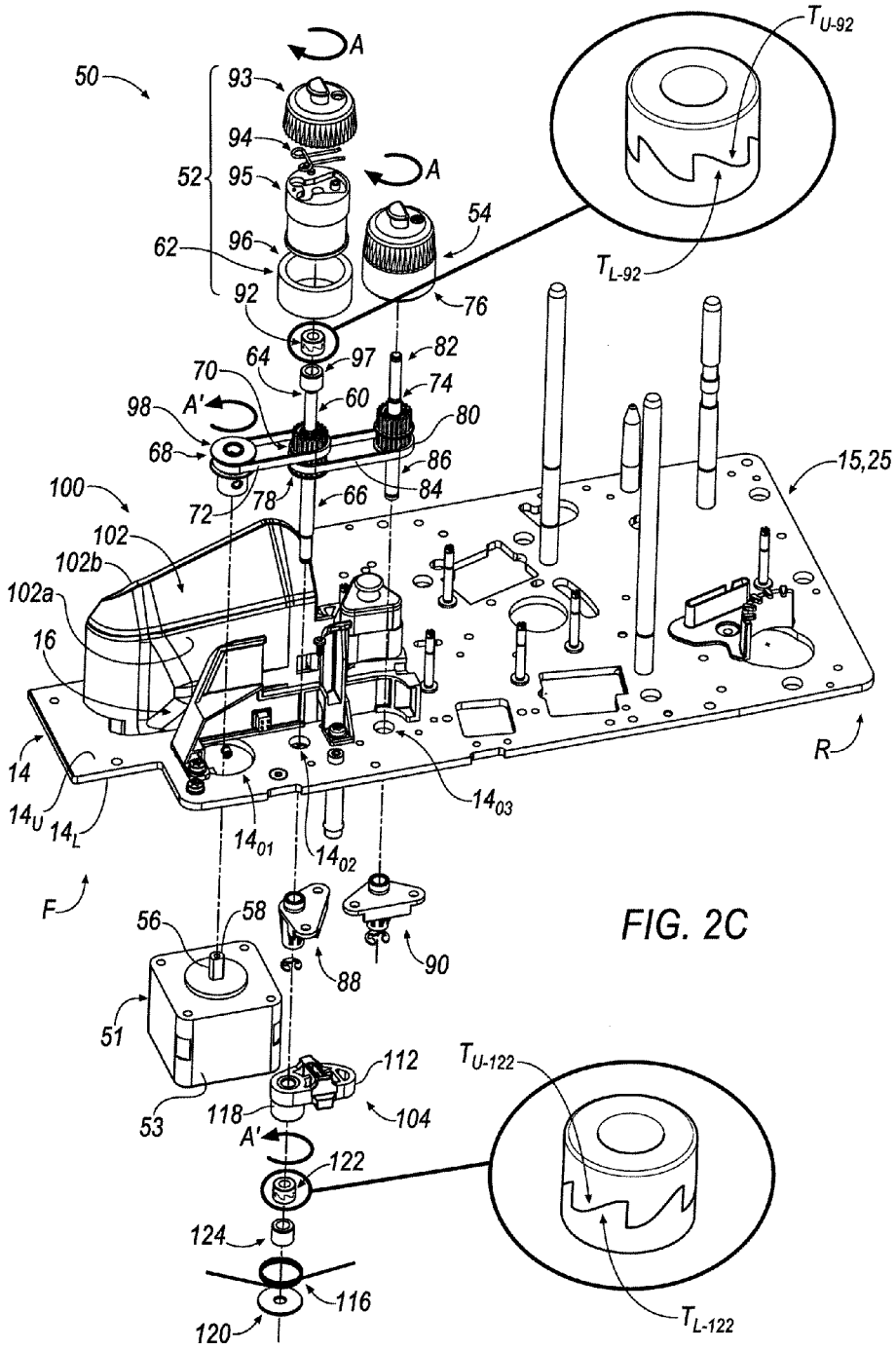
FIG. 2C is a top partial assembled/partial exploded perspective view of an exemplary document processing apparatus.

Referring to FIG. 1, in an implementation, the document processor 10 includes an outer protective shell 12. Referring to FIGS. 2A-2C, when the outer protective shell 12 is removed, a baseplate 14 is shown that may functionally support the electronics 15, one or more mechanical components 25 or the like. The baseplate 14 includes an upper surface $\mathbf{14}_U$ and a lower surface $\mathbf{14}_L$. The outer protective shell 12 and baseplate 14 may include any desirable material such as, for example, plastic, metal or the like.

One or more of the upper surface $\mathbf{14}_U$ and the lower surface $\mathbf{14}_L$ of the baseplate 14 may be connected to and/or support the electronics 15 and the one or more mechanical components 25. The electronics 15 and the one or more mechanical components 25 may cooperate in order to functionally assist in the movement of the at least one document, D, through the document processor 10 along a document path, DP (see, e.g., FIGS. 5A, 5B, 5C). Further, the electronics 15 and the one or more mechanical components 25 may cooperate to permit the performance of the document processing functions described above.

The outer protective shell 12 may be coupled to, for example, the upper surface $\mathbf{14}_U$ of the baseplate 14 with, for example, fasteners, a snap-fit connection, adhesive or the like. In an implementation, some of one or more of: the outer protective shell 12, the baseplate 14, the electronics 15 and the one or more mechanical components 25 may be connected to one another in order to form an assembly 50 (see, e.g., FIGS. 2A-3B). Further, as described in the following disclosure, some of one or more of: the outer protective shell 12, the baseplate 14, the electronics 15 and the one or more mechanical components 25 may be connected to one another in order to form a sub-assembly 100 (see, e.g., FIGS. 2A-3B) of the document processor 10; accordingly, it will be appreciated that an absence of one or more of the outer protective shell 12 and/or the baseplate 14 and/or the electronics 15 and/or some of the one or more mechanical components 25 may still yield the assembly 50 and/or sub-assembly 100 being operable for a particular function/sub-function that is to be performed by the document processor 10.

The outer protective shell 12 may define at least a portion of a housing that may cover or protect the electronics 15 and some of the one or more mechanical components 25. Further, referring to FIG. 1, when the outer protective shell 12 and the baseplate 14 are connected together, a portion of one or more of the outer protective shell 12 and the baseplate 14 may cooperate to form a first pocket portion 16 and a second pocket portion 18. In an embodiment, the first pocket portion 16 may be referred to as an "input hopper" for receiving at least one un-processed document, $D_U$, and in an embodiment, the second pocket portion 18 may be referred to as an "output bin" for receiving/storing at least one processed document, D.

The nomenclature associated with the "at least one un-processed document, $D_U$," and the "at least one processed document, $D_P$," may be dependent upon (1) the location of the at least one document, D, relative to the structure of the document processor 10 and (2) the un/successful performance of the one or more processing application functions applied to the at least one document, D, as the at least one document, D, is moved along the document path, DP. For example, when the at least one document, D, is located/disposed within the input hopper 16, the at least one document, D, may be referred to as the "at least one un-processed document, $D_U$;" subsequently, when the at least one un-processed document, $D_U$, is (1) drawn out of/moved from the input hopper 16, then (2) passed through the document processor 10 along the document path, DP, in order to attempt to perform the one or more document processing application functions and then (3) deposited into the output bin 18, the at least one un-processed document, $D_U$, may then be referred to as the "at least one processed document, $D_P$."

The input hopper 16 may be formed by first opposing wall portions 12*a*', 12*a*". One of more of the first opposing wall portions 12*a*', 12*a*" may include a portion of one or both of the outer protective shell 12 and a portion of the upper surface $\mathbf{14}_U$ of the baseplate 14, and/or, alternatively, a separate component (see, e.g., FIG. 2B).

In an implementation, the output bin 18 may include one or more bins. Accordingly, in the illustrated embodiment, the output bin 18 may include, but is not limited to, for example, a first output bin 18*a* and a second output bin 18*b*.

In an embodiment, the first output bin 18*a* may be formed by second opposing wall portions 12*b*', 12*b*". One or more of the second opposing wall portions 12*b*', 12*b*" may include a portion of one or both of the outer protective shell 12 and the upper surface $\mathbf{14}_U$ of the baseplate 14.

In an embodiment, the second output bin 18*b* may be formed by third opposing wall portions 12*c*', 12*c*". One or more of the third opposing wall portions 12*c*', 12*c*" may include a portion of one or both of the outer protective shell 12 and the upper surface $\mathbf{14}_U$ of the baseplate 15A.

In an implementation, one or more of the outer protective shell 12 and the upper surface $\mathbf{14}_U$ of the baseplate 14 may form a divider element 20 that partitions the output bin 18 in order to form the first output bin 18*a* and the second output bin 18*b*. The divider element 20 may include the wall portion 12*b*" of the first output bin 18*a* and the wall portion 12*c*' of the second output bin 18*b*.

In an implementation, the one or more mechanical components 25 of the document processor 10 may include an output bin selector 22 that is pivotably-arranged relative to the upper surface $\mathbf{14}_U$ of the baseplate 14. The output bin selector 22 may be pivotably-arranged relative to the upper surface $\mathbf{14}_U$ of the baseplate 14 in one or two orientations in response to a signal that is sent from the electronics 15. Further, the output bin selector 22 is located proximate, but upstream of the output bin 18 and the divider element 20.

When the electronics 15 cause movement of the output bin selector 22 to be located in a first orientation relative to the baseplate 14, the output bin selector 22 directs the at least one document, D, from the document path, DP, and into the first output bin 18*a*. Conversely, when the electronics 15 cause movement of the output bin selector 22 to be located in a second orientation relative to the baseplate 14, the output bin selector 22 directs the at least one document, D, from the document path, DP, and into the second output bin 18*b*.

Functionally, the output bin selector 22 permits the at least one document, D, to be sorted into one of the first output bin 18*a* or the second output bin 18*b* based on or more pre-programmed "criteria" that is stored in/determined by the electronics 15 during the one or more processing application functions. The "criteria" that results in the sorting of the at least one document, D, may include, but is not limited to, for example: a determined high currency value amount associated with the at least one document, D, a determined quality of an image of the at least one document, D, one or more successful processing criteria of the at least one document, D, one or more unsuccessful processing criteria of the at least one document, D, or the like.

Referring to FIGS. 1-2C, the assembly 50 and the sub-assembly 100 may be said to be generally located at a front end, F, of the document processor 10. The document processing functions described above may be conducted by the electronics 15 and some of the mechanical components 25 that may be said to be located at a rear end, R, of the document processor 10 and are not described in greater detail in the following disclosure; accordingly, the remaining disclosure will focus on the cooperation of the electronics 15 and the one or more mechanical components 25 that may be located proximate the front end, F, of the document processor 10.

The Assembly 50

At least a portion of the assembly 50 is permitted to be in physical communication with the at least one document, D, arranged within the input hopper 16 for the purpose of advancing the at least one document, D, from the input hopper 16 at the front end, F, along the document path, DP, toward the rear end, R, and back to the output bin 18 at the front end, F, of the document processor 10 in order to attempt to perform the one or more document processing application functions. Referring to FIGS. 2A-3B, the assembly 50 may include a feed motor 51, a nudger wheel 52 and a feeder wheel 54. The feed motor 51 may be mounted to/arranged over the lower surface $\mathbf{14}_L$ of the baseplate 14 whereas the nudger wheel 52 and the feeder wheel 54 may be mounted to/arranged over the upper surface $\mathbf{14}_U$ of the baseplate 14.

In an implementation, a drive shaft 56 (see, e.g. FIG. 2C) extends from the feed motor 51 and into a first opening $\mathbf{14}_{O1}$ (see, e.g. FIG. 2C) of the baseplate 14. An upper portion 58 of the drive shaft 56 may extend through the first opening $\mathbf{14}_{O1}$ of the baseplate 14 and beyond the upper surface $\mathbf{14}_{U}$ of the baseplate 14.

In an implementation, a driven shaft 60 (see, e.g., FIG. 2C) extends from a lower surface 62 of the nudger wheel 52 and into a second opening $\mathbf{14}_{O2}$ of the baseplate 14. The driven shaft 60 includes a first, upper portion 64 and a second, lower portion 66. The first, upper portion 64 of the driven shaft 60 is located between the lower surface 62 of the nudger wheel 52 and the upper surface $\mathbf{14}_{U}$ of the baseplate 14 whereas the second, lower portion 66 of the driven shaft 60 extends through the second opening $\mathbf{14}_{O2}$ of the baseplate 14 and beyond the lower surface $\mathbf{14}_{L}$ of the baseplate 14.

Each upper portion 58, 64 of the drive shaft 56 and driven shaft 60 includes aligned toothed, belt-receiving channels 68, 70. A toothed belt 72 is disposed within each toothed, belt-receiving channel 68, 70 for rotatably-connecting the drive shaft 56 to the driven shaft 60.

In an implementation, a driven shaft 74 (see, e.g., FIG. 2C) extends at least from a lower surface 76 of the feeder wheel 54. The driven shaft 74 may be rotatably-connected to the upper surface $\mathbf{14}_{U}$ of the baseplate 14.

The upper portion 64 of the driven shaft 60 extending from the nudger wheel 52 may further include a second, toothed, belt-receiving channel 78 that is aligned with a toothed, belt-receiving channel 80 of an upper portion 82 of the driven shaft 74. A toothed belt 84 is disposed within each toothed, belt-receiving channel 78, 80 for rotatably-connecting the driven shaft 60 of the nudger wheel 52 to the driven shaft 74 extending from the lower surface 76 of the feeder wheel 54.

The driven shaft 74 further includes a lower portion 86. The upper portion 84 of the driven shaft 74 is located between the lower surface 76 of the feeder wheel 54 and the upper surface $\mathbf{14}_{U}$ of the baseplate 14 whereas the lower portion 86 of the driven shaft 74 extends through a third opening $\mathbf{14}_{O3}$ of the baseplate 14 and beyond the lower surface $\mathbf{14}_{L}$ of the baseplate 14.

With continued reference to FIG. 2C, the toothed, belt-receiving channel 68 may be formed by a pulley cap 98 (that is described in greater detail below) that is connected to the upper portion 58 of the drive shaft 56 whereas the toothed, belt-receiving channels 70, 78, 80 may be formed by gear members connected to the driven shafts 60, 74. With further reference to FIG. 2C, a first and second bearing mount are shown generally at 88, 90. The first bearing mount 88 may be arranged substantially adjacent the lower surface $\mathbf{14}_{L}$ of the baseplate 14 and aligned with the second opening $\mathbf{14}_{O2}$ of the baseplate 14 such that the second, lower portion 66 of the driven shaft 60 may be disposed within the first bearing mount 88. The second bearing mount 90 may be arranged substantially adjacent the lower surface $\mathbf{14}_{L}$ of the baseplate 14 and aligned with the third opening $\mathbf{14}_{O3}$ of the baseplate 14 such that the second, lower portion 86 of the driven shaft 74 may be disposed within the second bearing mount 90.

Referring to FIG. 2C, a one-way clutch is shown at 92. The one-way clutch 92 is said to be "disposed within" and comprise a component of the nudger wheel 52; in an implementation, the one-way clutch 92 is connected to the driven shaft 60. Further, the nudger wheel 52 may be said to further include a ribbed feeding cap 93, a retaining snap wire 94, a core feed wheel 95, a drive-tire feed wheel 96 and a bushing feed wheel 97. Although the feeder wheel 54 is not shown in an exploded view in FIG. 2C, the feeder wheel 54 may include the same components 92-97 and operate substantially similarly as that of the nudger wheel 52 (i.e., a one-way clutch 92 may be said to be "disposed within" and comprise a component of the feeder wheel 54; in an implementation, the one-way clutch 92 of the feeder wheel 54 is connected to the driven shaft 74).

Further, as will be described in the following disclosure, a one-way clutch 122 may be said to be disposed within and comprise a component of a cam member 104. Accordingly, an implementation of the document processor 10 may be said to contain a total three one-way clutches: two one-way clutches 92 (i.e. one of which is disposed within the nudger wheel 52 and the other of which is disposed in the feeder wheel 54) and one one-way clutch 122 disposed within the cam member 104. Although the document processor 10 includes a total of three one-way clutches 92, 122, the one-way clutch 122 of the cam member 104 is mounted in the opposite sense to that of the one-way clutches 92 within the nudger wheel 52 and the feeder wheel 54 (i.e., the one-way clutch 92 in each of the nudger wheel 52 and feeder wheel 54 allows the nudger wheel 52 and the feeder wheel 54 to be driven in the direction indicated by arrow, A, whereas the clutch in the cam member 102 rotates in direction of arrow, A', that is opposite the arrow, A); this aspect is further illustrated in FIG. 2C where upper teeth, $T_{U\text{-}92}$, and lower teeth, $T_{L\text{-}92}$, of the one-way clutch 92 are meshed for operation in a first direction (i.e., according to arrow, A) whereas the upper teeth, $T_{U\text{-}122}$, and lower teeth, $T_{L\text{-}122}$, of the one-way clutch 122 are meshed for operation in a second direction (i.e., according to arrow, A') that is opposite that of the first direction, A. Because the general construction and operation of one-way clutches are known to one skilled in the art, the orientation of the teeth, $T_{U\text{-}92}$, $T_{L\text{-}92}$, $T_{U\text{-}122}$, $T_{L\text{-}122}$, are shown at FIG. 2C for illustrative purposes only and a further discussion of other sub-components of the one-way clutches 92, 122 are not described in further detail here. Accordingly, when the feed motor 51 is rotated in a reverse direction (i.e., according to the direction of arrow, A'), the one-way clutch 122 within the cam member 104 would engage and set forth an operational movement of the cam member 104, which is described in greater detail below. Conversely, when the feed motor 51 is rotated in a forward direction (i.e. in a direction opposite that of the arrow, A'), the motor 51 rotates a pulley 98 in order to drive the toothed belts 72, 84 in order to rotate the nudger wheel 52 and feeder wheel 54 such that the nudger wheel 52 and feeder wheel 54 may feed the one or more documents, D, through the document processor 10 along the document path, DP.

The Sub-Assembly 100

The sub-assembly 100 is connected to the assembly 50. Like the assembly 50, at least a portion of the sub-assembly 100 is permitted to physically communicate with the at least one document, D, arranged within the input hopper 16 at the front end, F, of the document processor 10 for the purpose of selectively dis/engaging the at least one document, D, placed in the input hopper 16; when selectively engaged with the at least one document, D, the sub-assembly 100 moves/biases the at least one document, D, in a direction toward the nudger wheel 52 of the assembly 50.

Referring to FIGS. 1-2C, in an implementation, the sub-assembly 100 may include a document-engaging component 102 and the cam member 104 (see, e.g., FIG. 2C). The document-engagement component 102 may be referred to as a flag. In an implementation, the flag 102 may be arranged within the input hopper 16 and over the upper surface $\mathbf{14}_{U}$ of the baseplate 14 whereas the cam member 104 may be arranged over the lower surface $\mathbf{14}_{L}$ of the baseplate 14.

In an implementation, a rod 106 (see, e.g. FIG. 3A) extends from a lower surface of the flag 102 and into a fourth opening $\mathbf{14}_{O4}$ of the baseplate 14. A lower portion 108 of the rod 106 may extend through the through fourth opening $\mathbf{14}_{O4}$ of the baseplate 14 and beyond the lower surface $\mathbf{14}_L$ of the baseplate 14. The lower portion 108 of the rod 106 may include a roller 110 attached thereto. The fourth opening $\mathbf{14}_{O4}$ of the baseplate 14 includes an elongated, arcuate geometry that permits the rod 106 to travel forwardly or backwardly within the fourth opening $\mathbf{14}_{O4}$ and relative to the baseplate 14 along an arcuate path, AP.

Referring to FIG. 2A, because of the permitted forwardly or backwardly travel of the rod 106 within the fourth opening $\mathbf{14}_{O4}$, the flag 102, which is attached to the rod 106, is said to be conjunctively move with the rod 106 such that the flag 102 may be movably-arranged in a forwardly or backwardly direction along the arcuate path, AP, within the input hopper 16. The flag 102 includes a front, document-contacting surface 102*a* and a rear surface 102*b*. The front, document-contacting surface 102*a* faces the wall portion 12*a*' whereas the rear surface 102*b* faces the wall portion 12*a*". A spring mechanism (not shown) may be connected to one or more of the wall portion 12*a*" and the rear surface 102*b* of the flag 102 for applying a biasing force (see direction of arrow 101 in FIG. 1) to the flag 102 such that the flag 102 and the rod 106 may be movably-biased in the forwardly direction such that the flag 102 may be biased to be arranged in a closed orientation (see, e.g., FIG. 5C) such that the front, document-contacting surface 102*a* of the flag 102 is located substantially adjacent the wall portion 12*a*'.

Referring to FIG. 2C, in an implementation, the cam member 104 is connected to the second, lower portion 66 of the driven shaft 60. The cam member 104 includes an engagement, camming surface 112 that engages an outer surface 114 (see, e.g., FIG. 3A) of the roller 110. As will be discussed in the following disclosure at FIGS. 6A-6C, the engagement, camming surface 112 of the cam member 104 is arranged to be in contact with the outer surface 114 of the roller 110 such that upon rotation, R (see, e.g., FIG. 6C), of the cam member 104, the engagement, camming surface 112 pushes, P' (see, e.g., FIG. 6C), the roller 110 and rod 106 in a manner for causing the rod 106 to be movably-located within the fourth opening $\mathbf{14}_{O4}$ in a manner that results in the rod 106 and the flag 102 being moved from the "closed orientation" (see, e.g., FIG. 6C) back to the "open orientation" (see, e.g., FIG. 6A).

Referring to FIG. 2C, in an implementation, the sub-assembly 100 may further include a biasing member including, for example, a torsion spring 116 arranged about a stem 118 extending from the cam member 104. A retaining washer 120 may be connected to the stem 118 to assist in retaining the torsion spring 116 upon the stem 118. The one-way clutch 122 (see FIGS. 3B and 4) and a bearing 124 are disposed within a bore 117 (see FIG. 4) of the stem 118 that extends from and is integrally-formed with the cam member 104.

Figure 4:
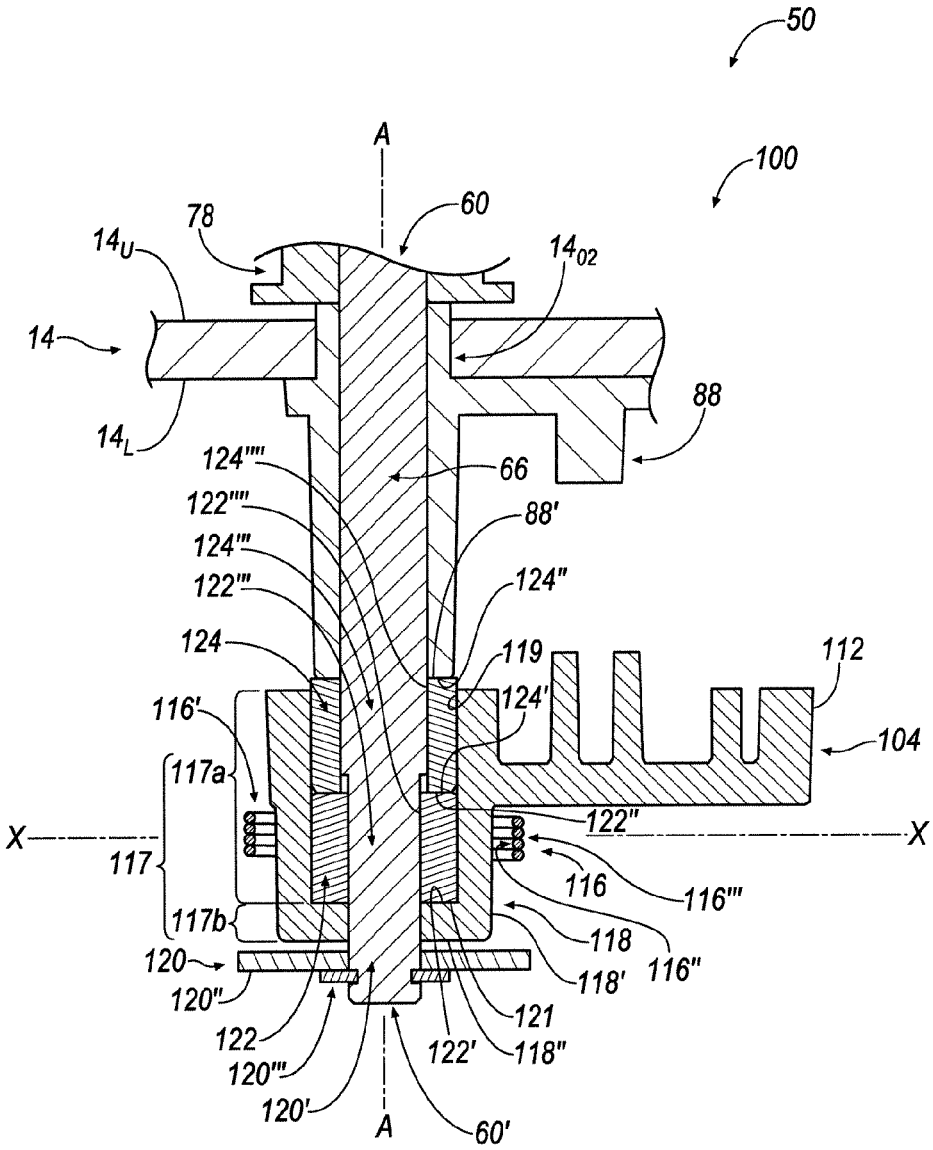
FIG. 4 is a cross-sectional view of a cam member according to line 4-4 of FIG. 3A.

As seen in FIG. 4, the bore 117 extends through the length of the stem 118. The bore 117 includes a first bore portion 117*a* having a first bore diameter and a second bore portion 117*b* having a second bore diameter that is less than the first bore diameter. The first bore portion 117*a* of the bore 117 is formed by an inner side surface 119. A support surface 121 extends substantially perpendicularly from the inner side surface 119.

The inner side surface 119 of the first bore portion 117*a* corresponds to an outer diameter of the one-way clutch 122 and bearing 124 such that upon disposing the one-way clutch 122 and bearing 124 within the first bore portion 117*a*, the one-way clutch 122 and the bearing 124 may be said to be wedged within the first bore portion 117*a*. Accordingly, the one-way clutch 122 may be disposed within the first bore portion 117*a* such that a lower end surface 122' of the one-way clutch 122 is disposed adjacent the support surface 121. A lower end surface 124' of the bearing 124 may be disposed adjacent an upper end surface 122" of the one-way clutch 122. An upper end surface 124" of the bearing 124 may be disposed adjacent a lower end surface 88' of the first bearing mount 88.

As seen in FIG. 4, each of the one-way clutch 122 and bearing 124 include bores 122'''', 124''''. The bores 122'''', 124'''' are each formed by an inner side surface 122''''', 124''''' of each of the one-way clutch 122 and bearing 124. The bores 122'''', 124'''' are axially-aligned with an axis, A-A, extending through the bore 117 of the stem 118. The inner side surface 122''''', 124''''' of each of the bores 122'''', 124'''' correspond to an outer diameter of the lower portion 66 of the driven shaft 60 such that upon disposing the lower portion 66 of the driven shaft 60 within the each of the bores 117, 122'''', 124'''' along the axis, A-A, the lower portion 66 of the driven shaft 60 may be said to be wedged within each of the bores 117*b*, 122'''', 124''''.

Figure 3A:
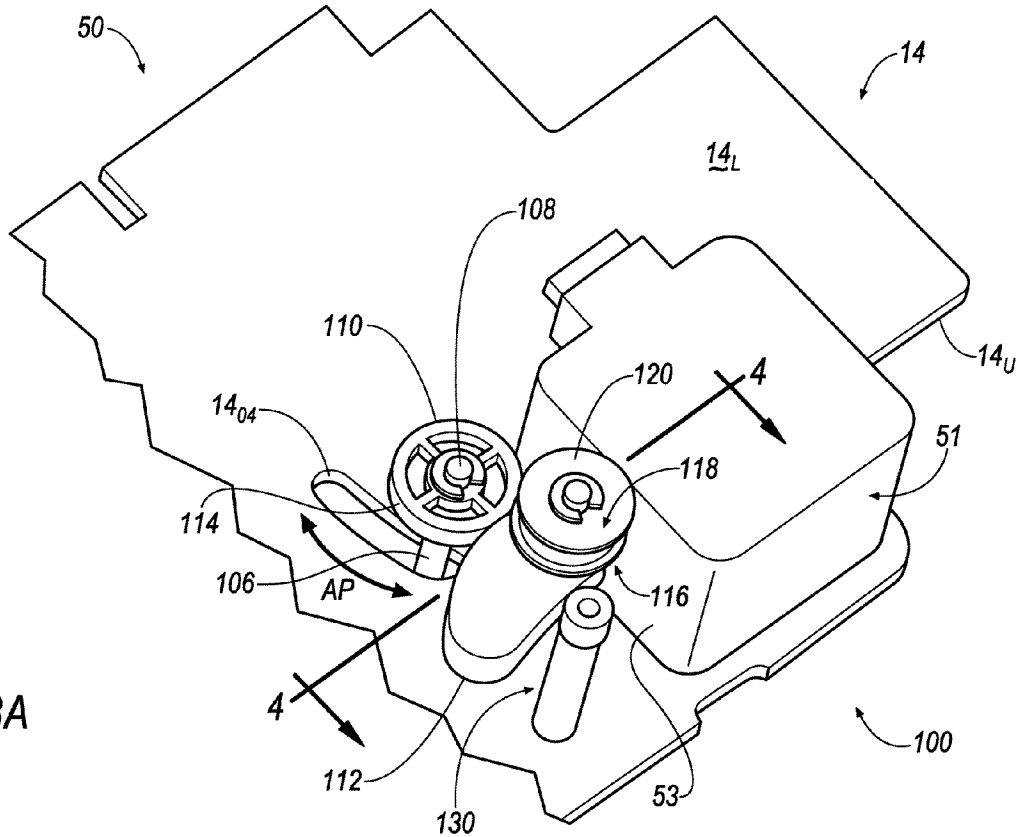
FIG. 3A is partial, bottom perspective view of an exemplary document processing apparatus.
Figure 3B:
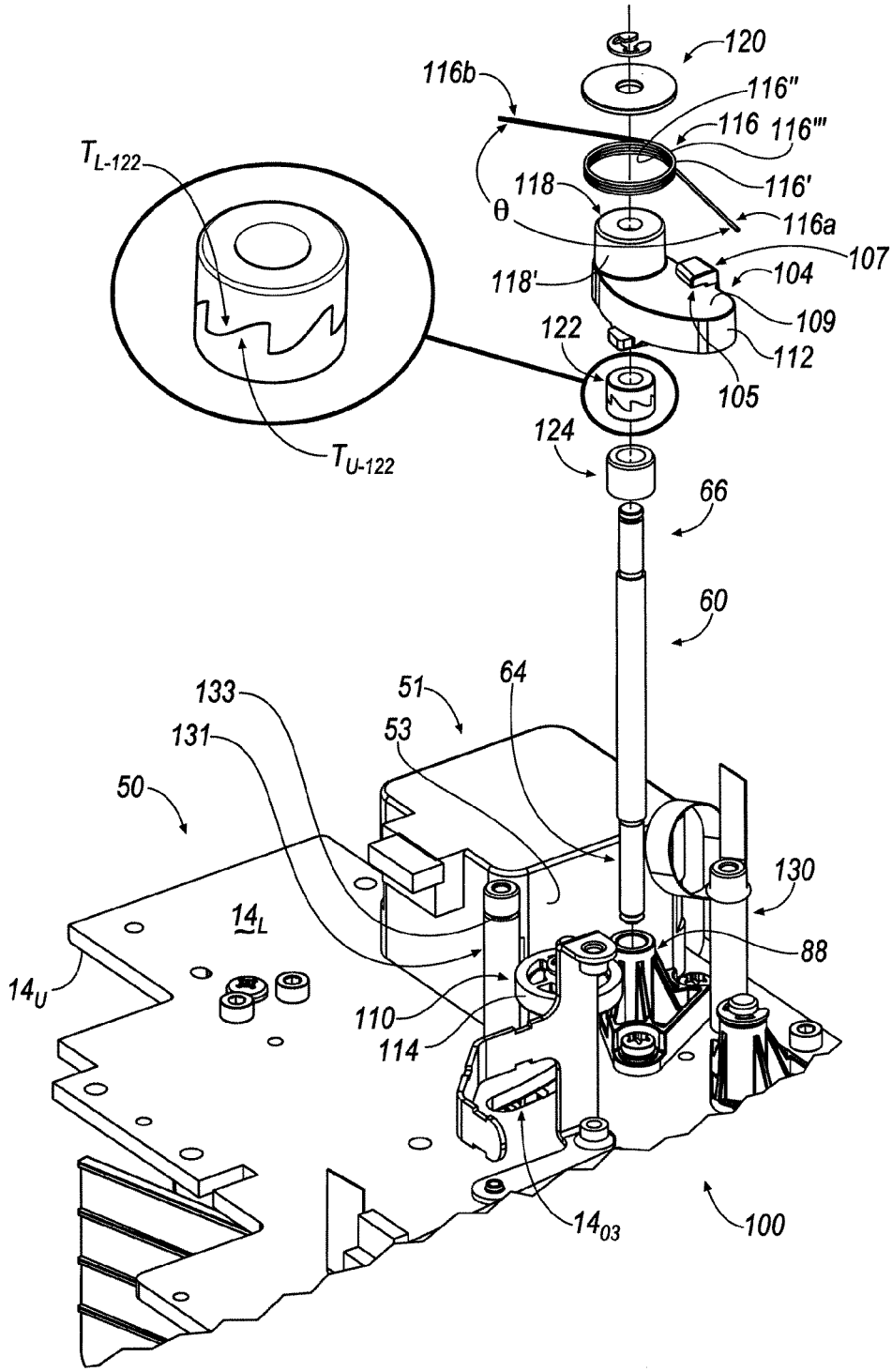
FIG. 3B is a bottom partial assembled/partial exploded perspective view of an exemplary document processing apparatus.

With continued reference to FIG. 4, the torsion spring 116 may include a coiled segment 116' that is formed by an inner bore diameter 116" and an outer diameter 116'''. Referring to FIG. 3B, the torsion spring 116 may further include a first leg 116*a* extending from the coiled segment 116' and a second leg 116*b* extending from the coiled segment 116'. The torsion spring 116 may be arranged about an outer surface 118' of the stem 118 such that the inner bore diameter 116" of the torsion spring 116 is arranged in a substantially spaced-apart or an adjacent relationship with the outer surface 118' of the stem 118, which depends on the orientation of the cam member 104, which will be explained in greater detail at FIGS. 5A-6C. As seen in FIG. 3B, the first leg 116*a* of the torsion spring 116 may be inserted in a channel 105 formed by an L-shaped member 107 and a lower surface portion 109 of the cam member 104; the L-shaped member 107 may extend from the lower surface 109 of the cam member 104 and may be referred to as a first spring leg catch/retainer. The second leg 116*b* of the torsion spring 116 may be disposed adjacent a stop post 131 extending from the lower surface $\mathbf{14}_L$ of the baseplate 14; the stop post 131 may further include a channel 133 or groove that catches/retains the second leg 116*b*.

In an implementation, the inner bore diameter 116" of the spring 116 generally corresponds to the outer surface 118' of the stem 118 such that upon disposing the coiled segment 116' of the spring 116 about the stem 118 and the first and second legs 116*a*, 116*b* in the channels 105, 133, the spring 116 may be said to be spatially retained about the stem 118. Further, as will be described in the following disclosure, the spatial retaining of the spring 116 about the stem 118 results in a manner such that coiled segment 116' of the spring 116 indirectly circumscribes (as a result of the intervening stem 118) the one-way clutch 122 that is disposed within the first bore portion 117*a* of the stem 118; accordingly, the one-way clutch 122, the stem 118 and the coiled segment 116' of the spring 116 may be said to be concentrically aligned in a common plane, X-X, that is substantially perpendicular to the axis, A-A.

Once the lower portion 66 of the driven shaft 60 is disposed within the each of the bores 122'''', 124'''', a distal end 60' of the driven shaft 60 may extend beyond a distal end 118" of the stem 118. The retaining washer 120 may also include a bore 120' that includes a substantially similar geometry to that of the bores 117*b*, 122'''', 124". The lower portion 66 of the driven shaft 60 may extend through the bore 120' of the retaining washer 120. The distal end 60' of the driven shaft 60 may extend beyond a lower surface 120" of the retaining washer 120. An end ring 120'''' may be secured (e.g., riveted, adhered or mechanically-secured) proximate the distal end 60' of the driven shaft 60 for preventing the retaining washer 120, cam member 104, one-way clutch 122, bearing 124, torsion spring 116 and first bearing mount 88 to be axially-disconnected from the lower portion 66 of the driven shaft 60.

Referring to FIG. 2B, the wall portion 12*a*' is shown according to an embodiment. In an implementation, the wall portion 12*a*' may be a separate component from each of the outer protective shell 12 and the baseplate 14; the wall portion 12*a*' may be secured to the upper surface $\mathbf{14}_U$ of the baseplate 14 with fasteners, such as, for example, screws, S. The wall portion 12*a*' may also include first and second openings $\mathbf{12}a'_{O1}$, $\mathbf{12}a'_{O2}$ such that the nudger wheel 52 and feeder wheel 54 may be arranged in a manner to be at least partially in communication with the input hopper 16.

Further, the sub-assembly 100 may include a sensor 125 connected to the wall portion 12*a*'. In operation, the sensor 125 may detect when one or more documents, D, has/have been inserted within the input hopper 16. In an implementation, the sensor 125 may be in communication with the feed motor 51 for the purpose of causing rotation of the feed motor 51. The sensor 125 may be any desirable sensor, such as, for example, an optical sensor.

Operation of the Assembly 50/Sub-Assembly 100

Figure 5A:
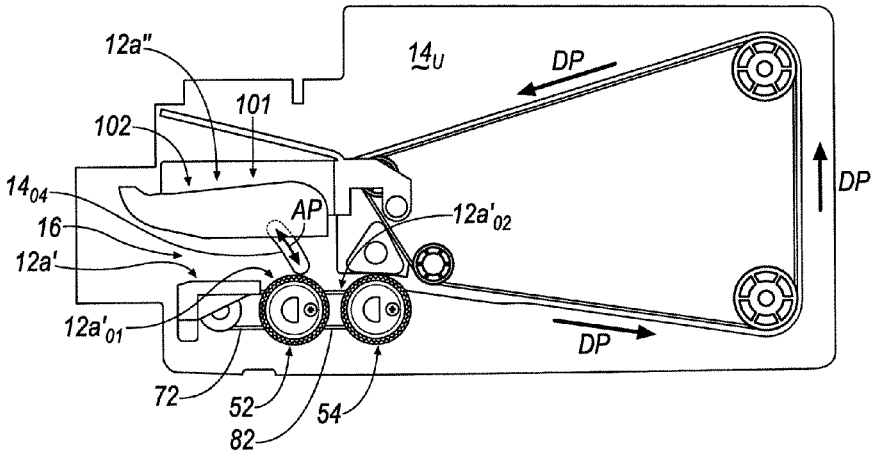
FIG. 5A is a partial, top plan view of an exemplary document processing apparatus including a flag arranged in an "open orientation."
Figure 5B:
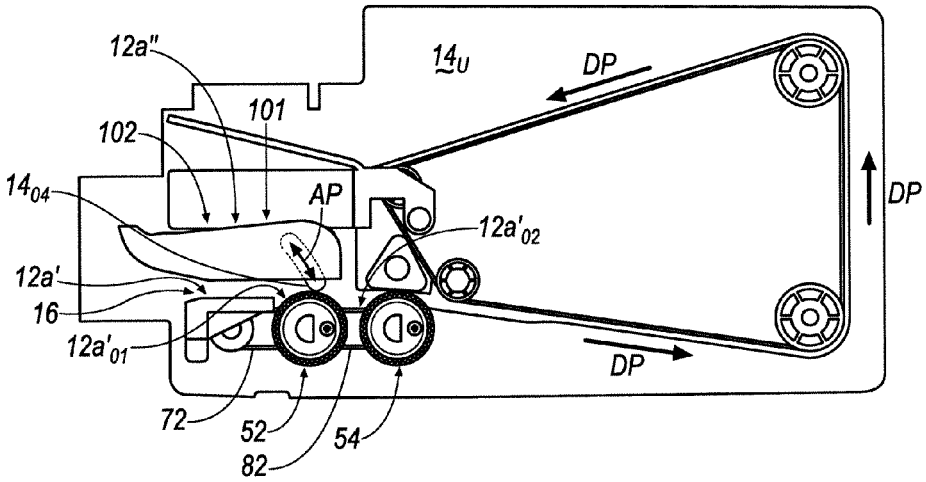
FIG. 5B is a partial, top plan view of the exemplary document processing apparatus of FIG. 5A including the flag arranged in an "intermediate orientation."
Figure 5C:
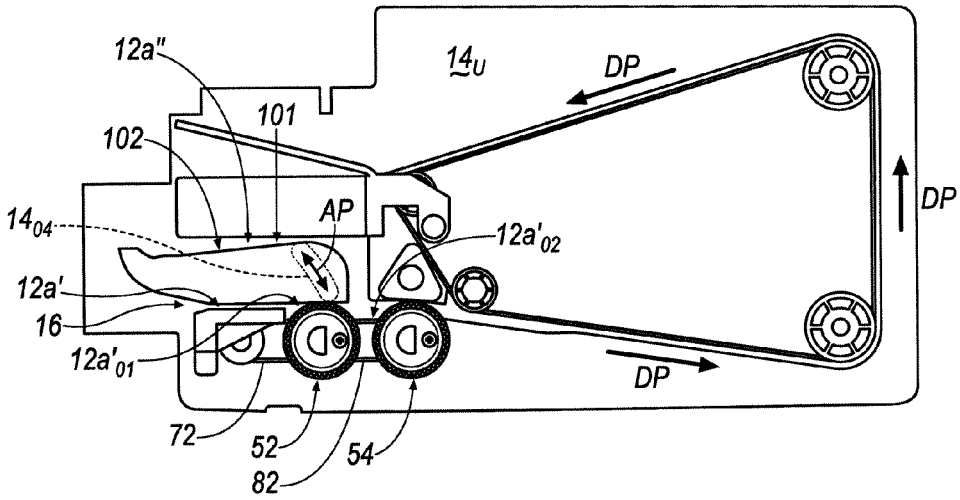
FIG. 5C is a partial, top plan view of the exemplary document processing apparatus of FIGS. 5A-5B including the flag arranged in a "closed orientation."

As seen in FIGS. 5A, 5B, 5C, the flag 102 is pivotably-disposed along the arcuate path, AP, within the input hopper 16 in one of: a fully retracted, "open orientation" proximate the wall portion 12*a*" (see, e.g., FIG. 5A), a fully deployed, "closed orientation" proximate the wall portion 12*a*' (see, e.g., FIG. 5C) and an intermediate orientation that is between but not located in the fully retracted/deployed, open/closed orientation (see, e.g., FIG. 5B). As will be explained in greater detail in the following disclosure, functionally, when a user deposits at least one document, D, within the input hopper 16, the electronics 15 (e.g., at least the sensor 125) may cooperate with some of the mechanical components 25 (e.g., at least the feed motor 51) to cause the flag 102 to move in an automatic, "self deploying" fashion from a default, fully retracted, "open orientation" (see, e.g., FIG. 5A) to at least a partially deployed, "closed orientation" (see, e.g., FIG. 5B/FIG. 5C) in order to move or otherwise bias the at least one document, D, positioned within the input hopper 16 toward or substantially adjacent the wall portion 12*a*' of the input hopper 16. Conversely, when the at least one document, D, is no longer located within the input hopper 16, the electronics 15 (e.g., at least the sensor 125) may cooperate with some of the mechanical components 25 (e.g., at least the feed motor 51) to cause the flag 102 to move in an automatic, "self-retracting" fashion, from the at least a partially deployed, "closed orientation" (see, e.g., FIG. 5C) to the fully retracted, "open orientation" (see, e.g., FIG. 5A). Accordingly, the document processor 10 may be utilized by an operator in a "one-handed" fashion that permits the operator to merely deposit or remove the at least one document, D, into/from the input hopper 16 with one hand such that the operator's other hand is not utilized to otherwise manually move the flag 102 toward the "open orientation" of FIG. 5A.

Referring to FIG. 5A, the document processor 10 is initially powered on (see, e.g., step S.201 in method 200) by depressing, for example a start/stop button, SS (see FIG. 1), or, by clicking upon a "start icon" displayed upon, for example, a monitor of the computer, C (see FIG. 1), and, by default, the flag 102 may be locked in the "open orientation;" if, for example, the flag 102 was not arranged in the "open orientation," upon powering on the document processor 10, the electronics 15 may sense/detect/recognize the non-"open orientation" of the flag 102 and send a signal to the feed motor 51 in order to cause movement of the flag 102 to the "open orientation." The default, locked nature of the flag 102, or, the "powered-on movement of the flag 102 toward the open orientation" will be described in greater detail in the following disclosure at steps S.202-S.204 of method 200.

Then, upon a user depositing the one or more documents, D, in the input hopper 16, the sensor 125 detects the one or more documents, D, and send a signal to the feed motor 51 for causing rotation of the feed motor 51 in the forward direction (see, e.g., steps S.205, S.206 in method 200). Rotation of the feed motor 51 in the forward direction causes the one-way clutches 92 in each of the nudger wheel 52 and feeder wheel 54 to respectively engage and clamp onto the driven shafts 60, 74 in order permit rotation to each of the nudger wheel 52 and feeder wheel 54 (as a result of each of nudger wheel 52 and feeder wheel 54 being connected to the feed motor 51 by way of the pulley cap 98 and toothed belts 72, 82 to the feed motor 51).

Figure 6A:
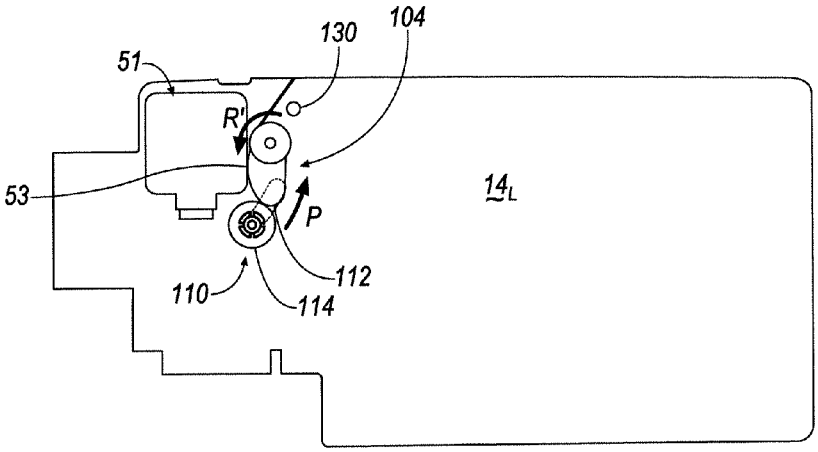
FIG. 6A is a partial, bottom plan view of the exemplary document processing apparatus corresponding to FIG. 5A including a cam member connected to the flag.
Figure 6B:
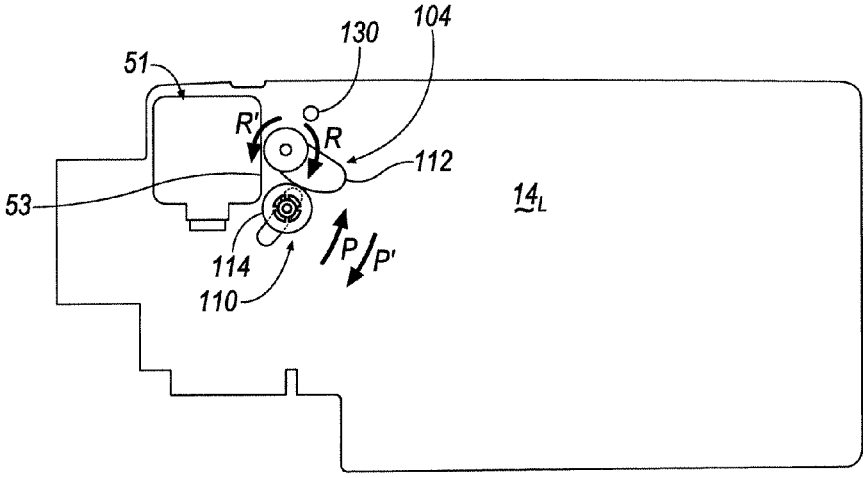
FIG. 6B is a partial, bottom plan view of the exemplary document processing apparatus corresponding to FIG. 5B including the cam member connected to the flag.
Figure 6C:
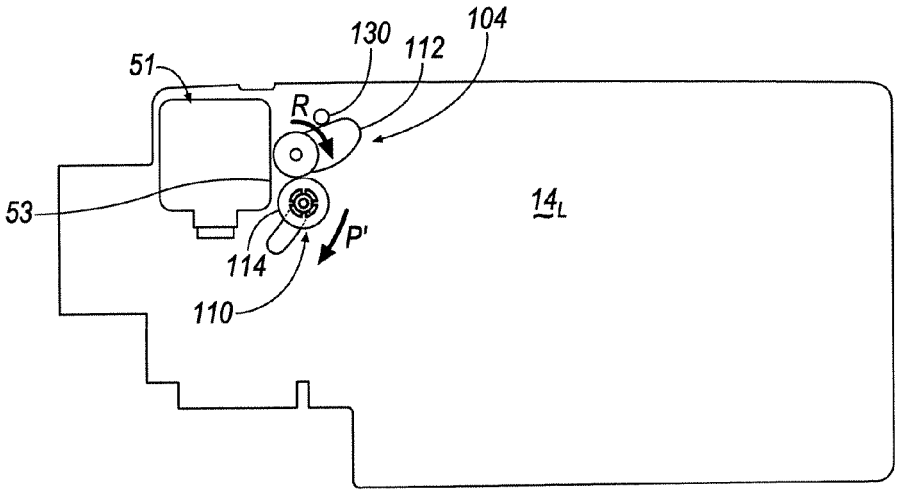
FIG. 6C is a partial, bottom plan view of the exemplary document processing apparatus corresponding to FIG. 5C including the cam member connected to the flag.
Figure 7:
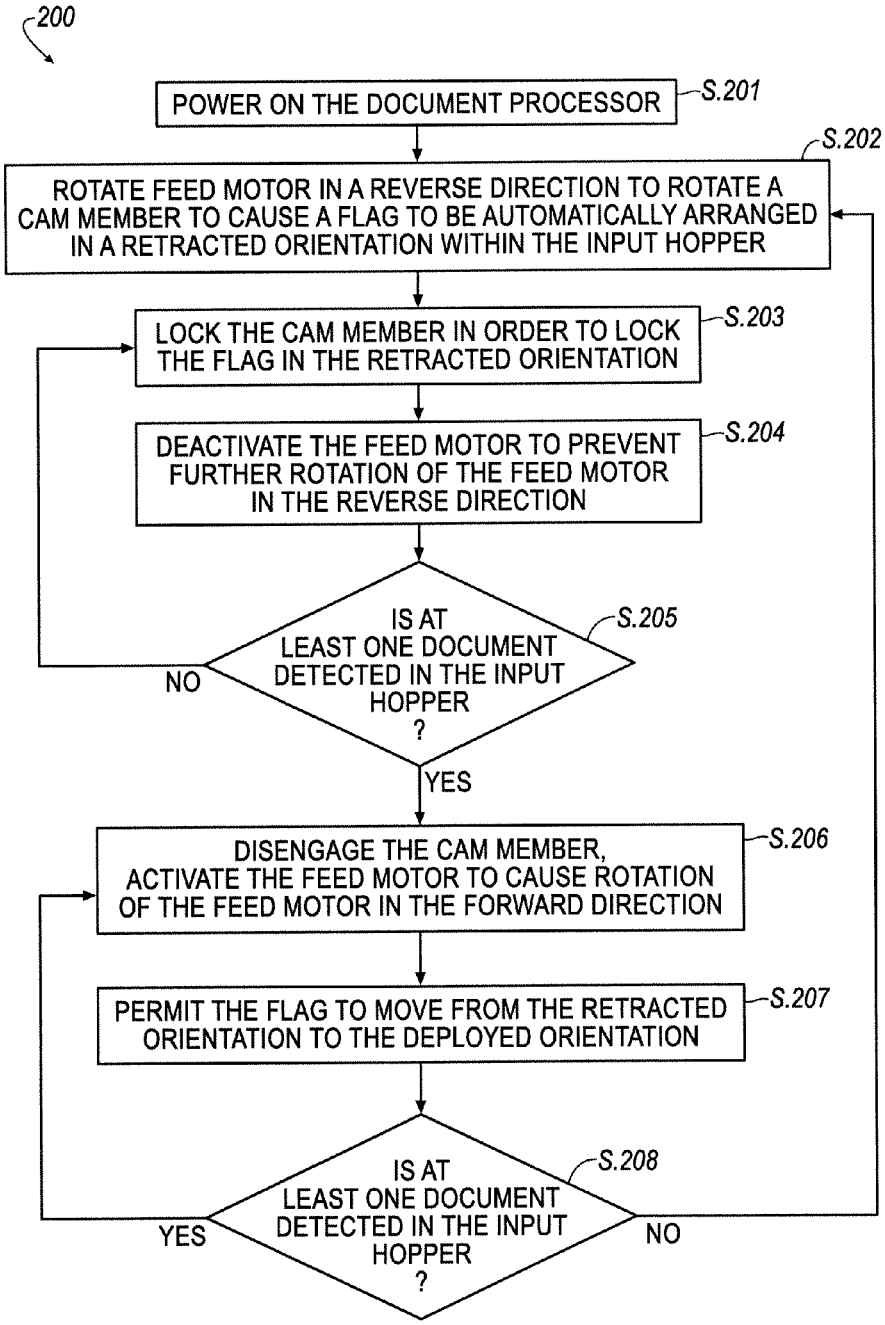
FIG. 7 is an exemplary flow diagram illustrating an exemplary method for operation an exemplary document processing apparatus.

Referring to FIG. 6A, when the feed motor 51 rotates in the forward direction, the one-way clutch 122 in the cam member 104 disengages from the driven shaft 60 (whereas, conversely, the one-way clutches 92 in each of the nudger wheel 52 and feeder wheel 54 respectively engage the driven shafts 60, 74). Accordingly, because the one-way clutch 122 is not engaged with the driven shaft 60, the one-way clutch 122 may be said to "free wheel" when disengaged with the driven shaft 60. Because the one-way clutch 122 "free wheels," the spring force 101 (see FIG. 5A) is imparted to the flag 102, which is translated to the rod 106, which causes the rod 106 to move within the fourth opening $\mathbf{14}_{O4}$ along the arcuate path, AP, such that the outer surface 114 of the roller 110 may push, P (see, e.g., FIGS. 6A, 6B), on the camming surface 112 of the free wheeling cam member 104 (as a result of the free-wheeling of the one-way clutch 122) for causing the cam member 104 to rotate according to the direction of the arrow, R'. Movement according to the direction of the arrow, P, is ceased when the outer surface 114 of the roller 100 eventually pushes, P,/rotates, R', the camming surface 112 of the cam member 104 into a stop post 130 extending from the lower surface $\mathbf{14}_L$ of the baseplate 14 (see, e.g., FIG. 6C); approximately at the same time the camming surface 112 of the cam member 104 engages the stop post 130, the one or more documents, D, may be exhausted from within the input hopper 16, and the input hopper 16 may said to be empty such that the flag 102 may be said to be arranged substantially adjacent the wall portion 12*a*' in the "closed orientation."

Once the one or more documents, D, are exhausted/removed/withdrawn from the input hopper 16 (e.g., as a result of the nudger wheel 52 and feeder wheel 54 feeding the one or more documents, D, through the document processor 10 along the document path, DP), or, if one or more documents, D, becomes stuck/jams along the document path, DP, the sensor 125/other sensors electronics 15 that detect documenting jamming along the document path, DP, may send a signal to the feed motor 51 to now rotate in the reverse direction (see, e.g., step S.208 then step S.202 of method 200). Rotation of the feed motor 51 in the reverse direction causes the one-way clutch 122 in the cam member 104 to engage and clamp onto the driven shaft 60 such that the one-way clutch 122 no longer free-wheels relative to the driven shaft 60, but, rather, the driven shaft 60 may now rotate the cam member 102 according to the direction of the arrow, R, which is opposite that of the direction of the arrow, R'; as a result, the camming surface 112 of the cam member 104 may push, P' (see, e.g., FIG. 6C), the outer surface 114 of the roller 110 in direction substantially opposite that of the arrow, P, such that the rod 106 and flag 102 are pushed, P', along with the roller 110. By pushing the rod 106 according to the direction of the arrow, P', the flag 102 is correspondingly moved with the rod 106 such that the flag 102 is moved from the "closed orientation" of FIG. 5C back to the "open orientation" of FIG. 5A. Further, when the feed motor 51 rotates in the reverse direction (see, e.g., step S.208 then step S.202 of method 200), the one-way clutches 92 in each of the nudger wheel 52 and feeder wheel 54 respectively disengage and free-wheel with respect to the driven shafts 60, 74 such that each of the nudger wheel 52 and feeder wheel 54 no longer rotate with the driven shafts 60, 74.

Further, as the cam member 104 rotates according to the direction of the arrow, R, the coiled segment 116' of the torsion spring 116 that is spatially-retained and wrapped around outer surface 118' of the stem 118 provides a small, but increasing torque couple between the cam member 104 and the driven shaft 60 such that the inner bore diameter 116" of the coiled segment 116' of the torsion spring 116 may be disposed substantially adjacent and "chokes" the outer surface 118' of the stem 118 (as a result of a reduced angular spacing, θ (see FIG. 3B) of the first and second legs 116*a*, 116*b* of the torsion spring 116 due to the L-shaped member 107 of the cam member 104 pulling the first leg 116*a* of the torsion spring 116 toward a fixed orientation of the second leg 116*b* of the torsion spring 116 that is disposed within the channel 133 of the stop post 131). Referring to FIGS. 5A, 6A, the applied torque eventually becomes sufficient to hold the one-way clutch 122 in the cam member 104 locked to the driven shaft 60 (see, e.g., step S.203 of method 200) when the driven shaft 60 ceases to rotate, R (i.e., when the cam member 104 is rotated, R, into and is physically engaged with an outer body surface 53 of the feed motor 51). Once the cam member 104 contacts the outer body surface 53 of the feed motor 51, the feed motor 51 may be deactivated and the one-way clutch 122 of the cam member 104 may remain locked to the driven shaft 60 until the feed motor 51 rotates in the forward direction (i.e., upon the sensor 125 detecting the one or more documents, D, in the input hopper 16); accordingly, once the feed motor 51 rotates in the forward direction (see, e.g., FIGS. S.205, S.206 of method 200) and commences to rotate the driven shaft 60 in the forward direction, the locking influence of the torsion spring 116 that causes the one-way clutch 122 to be engaged with the driven shaft 60 will be overcome such that the first leg 116*a* of the torsion spring 116 may push the L-shaped member 107 (and cam member 104) such that the cam member 104 will be urged to rotate according to the direction of the arrow, R'. Thus, the inner bore diameter 116" of the coiled segment 116' of the torsion spring 116 may be increasingly spaced apart from the outer surface 118' of the stem 118 and no longer "chokes" the one-way clutch 122. Thus, the one-way clutch 122 will disengage from the driven shaft 60 and permit the rod 106 to once again push upon the cam member 104 according to the direction of the arrow, P.

A number of implementations have been described. Nevertheless, it will be understood that various modifications may be made without departing from the spirit and scope of the disclosure. Accordingly, other implementations are within the scope of the following claims. For example, the actions recited in the claims can be performed in a different order and still achieve desirable results.

What is claimed is:

1. A sub-assembly of a document processor that routes at least one document from an input hopper, along a document path and to an output bin, the document processor comprising:

a flag movably-arranged within the input hopper to or from a closed orientation and an open orientation;

a rod fixed to and extending from the flag, wherein the rod includes an outer surface;

a cam member including a earning surface, wherein the camming surface is communicatively-coupled to the outer surface of the rod;

a driven shaft connected to the cam member, wherein the cam member further includes a one-way clutch, wherein the driven shaft extends through the one-way clutch; and a feed motor connected to the driven shaft.

2. The sub-assembly according to claim 1, wherein rotation of the driven shaft in a first direction provides means for:

disengaging and free-wheeling the one-way clutch with respect to the driven shaft that correspondingly results in the disengaging of the cam member from the driven shaft such that a biasing force exerted upon the flag may be translated to the cam member by way of the rod such that biasing force results in a first pushing movement of the rod that results in a first rotational movement of the cam member in order to result in the flag being arranged in a closed orientation within the input hopper.

3. The sub-assembly according to claim 2, wherein rotation of the driven shaft in a second direction opposite that of the first direction provides means for:

engaging the one-way clutch with the driven shaft that correspondingly results in the engaging of the cam member with the driven shaft such that the driven shaft rotates the cam member to yield a second rotational movement opposite that of the first rotational movement such that the cam member overcomes the biasing force exerted by the flag and results in a second pushing movement upon the rod in order to result in the flag being arranged from the closed orientation within the input hopper to an open orientation within the input hopper.

4. The sub-assembly according to claim 3 further comprising:

a torsion spring disposed about a stem portion of the cam member, wherein the torsion spring provides means for increasing a torque couple about the stem portion of the cam member and the driven shaft extending through the stem portion of the cam member such that, responsive to the second rotational movement of the cam member, the torsion spring is disposed substantially adjacent and chokes an outer surface of the stem in order to retain the one-way clutch locked to the driven shaft such that the flag is maintained in the open orientation.

5. The sub-assembly according to claim 3, wherein the feed motor provides means for rotating the driven shaft in the first direction when the feed motor rotates in a forward direction, wherein the feed motor provides means for rotating the driven shaft in the second direction when the feed motor rotates in a reverse direction.

6. The sub-assembly according to claim 5 further comprising:

a drive shaft extending from the feed motor, a pulley cap connected to the drive shaft extending from the feed motor, wherein the pulley cap includes a first, toothed, belt-receiving channel, a second, toothed belt-receiving channel and a third, toothed belt-receiving channel formed by the driven shaft, a first toothed belt disposed within each of and connecting the first, toothed, belt-receiving channel to the second, toothed belt-receiving channel, a second driven shaft including a fourth, toothed belt-receiving channel, and a second toothed belt disposed within each of and connecting the third, toothed, belt-receiving channel to the fourth, toothed belt-receiving channel.

7. The sub-assembly according to claim 6 further comprising:

a nudger wheel connected to driven shaft, and a feeder wheel connected to the second driven shaft, wherein both of the nudger wheel and the feeder wheel are in communication with the input hopper, wherein the nudger wheel includes a nudger wheel one-way clutch, wherein the driven shaft extends through the nudger wheel one-way clutch, wherein the feeder wheel includes a feeder wheel one-way clutch, wherein the second driven shaft extends through the feeder wheel one-way clutch.

8. The sub-assembly according to claim 7, wherein rotation of the feeder motor in the forward direction provides means for:

engaging the nudger wheel one-way clutch with the driven shaft while also engaging the feeder wheel one-way clutch with the second driven shaft such that rotation of each of the driven shaft and the second driven shaft results in rotation of the nudger wheel and feeder wheel for directing the at least one document from the input hopper toward the document path.

9. The sub-assembly according to claim 7, wherein rotation of the feeder motor in the reverse direction provides means for:

disengaging the nudger wheel one-way clutch with respect to the driven shaft while also disengaging the feeder wheel one-way clutch with respect to the second driven shaft such that rotation of each of the driven shaft and the second driven shaft does not result in a corresponding rotation of the nudger wheel and feeder wheel.

10. A method for operating a sub-assembly of a document processor according to claim 4 comprising the steps of:

determining that the at least one document is located within the input hopper;

activating the feed motor in a forward direction for rotating the driven shaft in a first direction for disengaging and free-wheeling the one-way clutch with respect to the driven shaft that correspondingly results in the disengaging of the cam member from the driven shaft such that a biasing force exerted upon the flag may be translated to the cam member by way of the rod such that biasing force results in a first pushing movement of the rod that results in a first rotational movement of the cam member in order to result in the flag being arranged in a closed orientation within the input hopper;

determining that the at least one document is not located within the input hopper; and activating the feed motor in a reverse direction for rotating the driven shaft in a second direction opposite that of the first direction for engaging the one-way clutch with the driven shaft that correspondingly results in the engaging of the cam member with the driven shaft such that the driven shaft rotates the cam member to yield a second rotational movement opposite that of the first rotational movement such that the cam member overcomes the biasing force exerted by the flag and results in a second pushing movement upon the rod in order to result in the flag being arranged from the closed orientation within the input hopper to an open orientation within the input hopper.

11. The method according to claim 10 further comprising the step of:

providing a torsion spring disposed about a stem portion of the cam member; and utilizing the torsion spring for increasing a torque couple about the stem portion of the cam member and the driven shaft extending through the stem portion of the cam member such that, responsive to the second rotational movement of the cam member, the torsion spring is disposed substantially adjacent and chokes an outer surface of the stem in order to retain the one-way clutch locked to the driven shaft such that the flag is maintained in the open orientation.

* * * * *

UNITED STATES PATENT AND TRADEMARK OFFICE

CERTIFICATE OF CORRECTION

PATENT NO. : 8,348,260 B2
APPLICATION NO. : 13/036703
DATED : January 8, 2013
INVENTOR(S) : Johan P. Bakker et al.

It is certified that error appears in the above-identified patent and that said Letters Patent is hereby corrected as shown below:

Please correct Claim 1 as follows:

At column 12, claim number 1, line number 1, delete the word "earning" and add the word -- camming --.

Signed and Sealed this
Second Day of April, 2013

Teresa Stanek Rea
*Acting Director of the United States Patent and Trademark Office*